United States Patent [19]

Wöhrle

[11] 4,413,586

[45] Nov. 8, 1983

[54] SIZE PRESS

[75] Inventor: Albert Wöhrle, Heidenheim, Fed. Rep. of Germany

[73] Assignee: J. M. Voith GmbH, Heidenheim, Fed. Rep. of Germany

[21] Appl. No.: 380,246

[22] Filed: May 20, 1982

[51] Int. Cl.[3] ..... B05C 1/08; B05C 3/12

[52] U.S. Cl. ..... 118/206; 118/249; 118/405

[58] Field of Search ..... 118/206, 405, 407, 249

[56] References Cited

U.S. PATENT DOCUMENTS 4,177,304 12/1979 Berry ..... 427/434 R
4,192,712 3/1980 Dreher ..... 118/206 X
4,259,921 4/1981 Wallsten ..... 118/206

FOREIGN PATENT DOCUMENTS 2953280 5/1980 Fed. Rep. of Germany .

*Primary Examiner*—John P. McIntosh
*Attorney, Agent, or Firm*—Albert L. Jeffers

[57] ABSTRACT

A size press having a plurality of rollers for the deposition of a size bath on both sides of a running paper web. The running paper web cooperates with a first roller to pick up size from a trough disposed below the first roller. Downstream of the first roller are second, third and fourth rollers, which are so disposed relative one to the other that the second and third rollers form a pressure gap therebetween and the third and fourth rollers form a second pressure gap therebetween. The size deposited on the running paper web from the trough is uniformly and efficiently metered thereon, and sufficient time is provided for a uniform penetration of the size into the running paper web, thereby resulting in a homogeneously sized web.

5 Claims, 1 Drawing Figure

SIZE PRESS

The present invention relates to a press, and more particularly to a size press having a plurality of rollers for depositing a size bath upon both sides of a running paper web.

A considerable number of size presses exist, one typical example being disclosed in West German Pat. No. 2,953,280 in FIG. 8 therein. There the web is guided first in one direction around a first roller and next around a second roller, both rollers forming therebetween a pressing slot or gap. At the first roller, size from a sump is applied to one side of the web by a metering roller, and the excess size in the gap between the rollers is smoothed and removed by a doctor. At the second roller, a second sump is formed by a scraper and size from the second sump is applied to the opposite side of the paper web.

A major disadvantage with this particular installation is that the sizing does not occur in a sufficiently homogeneous manner nor with sufficiently large amounts.

Another example of a size press is disclosed in U.S. Pat. No. 4,177,304. This press comprises three rollers, a central roller and two additional rollers one on either side of the central roller, and two gaps formed by a respective additional roller and the central roller. Each of these two gaps has a sump provided therewith so that the paper web receives a deposit of size on both of its sides as it passes through the gaps.

A major drawback with this particular press installation is that the amounts of size deposited are in too small a quantity and are not sufficiently uniformly deposited on the paper web.

The size press of the present invention provides for the deposition of size on both sides of a paper web which satisfies the following criteria: (a) a large amount of size should be deposited on both sides of the paper web; (b) the size should become uniformly distributed along all surfaces; (c) the size press should be capable of operating at high speeds; and (d) the cost of the size press should be kept to a minimal amount.

The present invention satisfies the above criteria by providing a size press having two roller gaps spaced apart a predetermined distance to allow size, which has been applied to one side of the paper web prior to the first roller gap, sufficient time to penetrate the paper web. The deposition by a first rotatable roller is advantageously accomplished by accurately metering just the required small amount of size on the web. Furthermore, such a deposition is very uniform, however, such is known in the art. Prior to the paper web reaching subsequent rotatable rollers, a relatively small amount of size has penetrated the web very evenly so that it is now in its highest state of absorbability. Because the paper web is now in a high state of absorbability, it is able to pick up or absorb greater amounts of size from the sump which is located between the subsequent rotatable rollers.

As described, the doctors disclosed in West German Pat. No. 2,953,280 and their inability to operate at high speeds are eliminated. Further, the last roller gap provided by the size press of the present invention between the subsequent rotatable rollers offers the additional advantage of again pressing the size deeper into the paper web, such an advantage being a desirable feature.

The surprisingly high quality of size absorption may find its explanation perhaps from the following analogy: if one wishes to thoroughly saturate a sponge with water, a very small amount of water should be first uniformly applied to the sponge. Such an application is accomplished by the metering roller of the size press of the present invention.

In reference to the above analogy, a completely dry sponge may absorb only very minimal amounts of moisture. Generally, any moisture absorbed by the dry sponge is absorbed only by particular areas of the sponge, or are absorbed throughout the sponge in a non-uniform manner. This particular type of absorption generally occurs with the device described in U.S. Pat. No. 4,177,304.

The device disclosed in West German Pat. No. 2,953,280 does not serve the purpose of the present invention in that the doctors disclosed in the West German Patent are not capable of operating at high speeds, are not suitable for presses having long widths, and do not provide a uniform size deposition.

BRIEF DESCRIPTION OF THE DRAWING

The above mentioned and other features and objects of this invention, and the manner of attaining them will become more apparent and the invention itself will be better understood by reference to the following description of an embodiment of the invention taken in conjunction with the accompanying drawing depicting in a side elevational view a preferred embodiment of the present invention.

DESCRIPTION OF A PREFERRED EMBODIMENT

Figure 1:
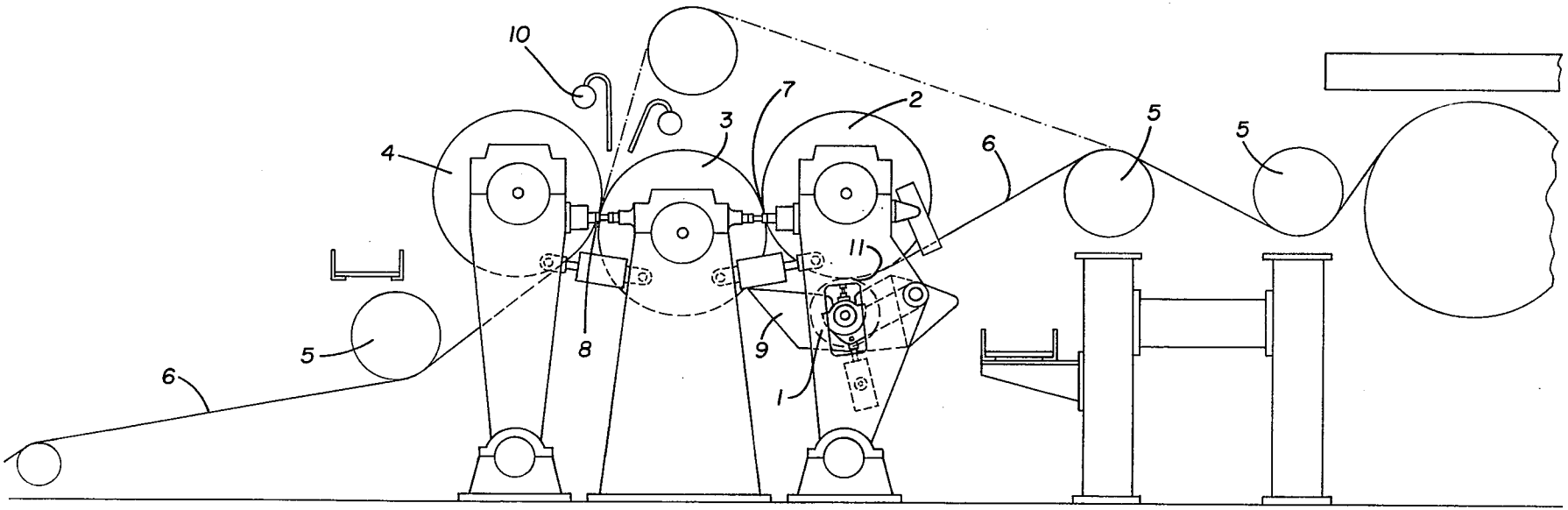

Referring to the drawing, four rollers, metering roller 1 and rollers 2, 3, 4, are horizontally and rotatably disposed relative to one another as depicted, and a plurality of guide rollers 5 are also provided.

A paper web 6 is introduced from the righthand side of the drawing into gap 11 formed between metering roller 1 and roller 2. It is important to realize that no contacting pressure is exerted within gap 11 because rollers 1 and 2 are disposed side-by-side in a spaced apart relationship. After being introduced through gap 11 between rollers 1 and 2, paper web 6 winds around a lower portion of roller 2, passes through gap 7 between rollers 2 and 3, and then winds around roller 3 for a certain length of its path, and subsequently passes through gap 8 between rollers 3 and 4. Metering roller 1 is disposed above trough 9 inside of which is located a sump of size, and a size feeding device 10 cooperates with gap 8 to supply size therein.

In operation, a portion of size from trough 9 is deposited upon the jacket surface of metering roller 1 and from this jacket surface is released to one side of paper web 6. The portion of size deposited here is of a relatively small amount per unit area, and arrives in a highly homogeneous distribution upon the one side of paper web 6. After being applied to the one side of paper web 6, the portion of size is provided sufficient time to penetrate within paper web 6.

Inside gap 7 between rollers 2 and 3, excess size is squeezed off of paper web 6 and flows back into trough 9, and the size which has penetrated paper web 6 is more thoroughly pressed therein.

As roller 3 rotates, paper web 6 continues to roller gap 8 and a size sump (not shown) located there. Paper web 6 arriving at roller gap 8 has been thoroughly and uniformly wetted with size previously deposited by metering roller 1. At this point, paper web 6 is in a state of absorbability in which it quickly and rapidly picks up size from the sump (not shown), thereby having a large amount of size uniformly deposited thereon. As paper web 6 passes through roller gap 8, excess size is removed therefrom by squeezing, and pressure is applied thereto to facilitate size penetration.

While this invention has been described as having a specific embodiment, it will be understood that it is capable of further modifications. This application is therefore intended to cover any variations, uses, or adaptations of the invention following the general principles thereof, and including such departure as come within known or customary practice in the art to which this invention pertains and fall within the limits of the appended claims.

What is claimed is:

1. A size press for depositing a bath of size on a moving paper web, comprising:

a first roller being rotatably mounted therein, a trough member adapted to contain a first sump of liquid and having at least a portion of said first roller disposed therein, a second roller being rotatably mounted therein and arranged substantially parallel to said first roller, said first and second rollers being spaced apart to form there between a first gap, said first roller being adapted to apply a predetermined amount of liquid to one side of the paper web at said first gap, a third roller being rotatably mounted therein and arranged substantially parallel to said second roller, said second and third rollers being slightly spaced apart to form there between a second gap at a first predetermined distance from said first gap to allow liquid applied to the one side of the paper web to penetrate therein, said second roller and said third roller being adapted to squeeze excess liquid from the paper web at said second gap, and a fourth roller being rotatably mounted therein and arranged substantially parallel to said first, second and third rollers, said fourth roller being adjacent to and spaced from said third roller to form a third gap therebetween at a second predetermined distance from said second gap to allow the paper web to reach a state of high absorbability, said fourth roller being further arranged relative to said third roller to provide a space adapted for receiving a second sump of a second liquid between respective outer surfaces of said third and fourth rollers, whereby the opposite side of the paper web has the second liquid applied thereto and the excess liquid squeezed therefrom when moved through said third gap, said first gap and said third gap being adapted to continuously support therebetween the paper web.

2. The press of claim 1 wherein said second roller is generally disposed above said first roller.

3. The press of claim 1 or 2 wherein said third roller has its longitudinal axis disposed slightly below the longitudinal axis of said second roller.

4. The press of claim 1 or 2 wherein said fourth roller has its longitudinal axis disposed slightly above the longitudinal axis of said third roller.

5. The press of claim 2 wherein said third roller has its longitudinal axis disposed slightly below the longitudinal axis of said second roller, said fourth roller has its longitudinal axis disposed slightly above the longitudinal axis of said third roller.

* * * * *